US010008147B2

(12) United States Patent
Nagahashi et al.

(10) Patent No.: US 10,008,147 B2
(45) **Date of Patent: *Jun. 26, 2018**

(54) MOVING IMAGE DISPLAY APPARATUS

(71) Applicant: YAZAKI CORPORATION, Minato-ku, Tokyo (JP)

(72) Inventors: Kenichi Nagahashi, Susono (JP); Akihiro Yoshida, Susono (JP); Tomotake Wakatsuki, Susono (JP); Hiroshi Nishiyama, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 8 days.

This patent is subject to a terminal disclaimer.

(21) Appl. No.: 15/410,500

(22) Filed: Jan. 19, 2017

(65) Prior Publication Data

US 2017/0132961 A1 May 11, 2017

Related U.S. Application Data

(63) Continuation of application No. 14/445,336, filed on Jul. 29, 2014, now Pat. No. 9,601,045, which is a (Continued)

(30) Foreign Application Priority Data

May 24, 2007 (JP) ..... 2007-137457

(51) Int. Cl.

| | |
|---|---|
| ***G09G 3/26*** | (2006.01) |
| ***G09G 3/00*** | (2006.01) |
| ***G09G 3/36*** | (2006.01) |

(52) U.S. Cl.

CPC ..... *G09G 3/26* (2013.01); *G09G 3/004* (2013.01); *G09G 3/3607* (2013.01); (Continued)

(58) Field of Classification Search

CPC ..... G09G 3/004; G09G 3/005; G09G 3/26

(Continued)

(56) References Cited

U.S. PATENT DOCUMENTS

| | | | |
|---|---|---|---|
| 1,402,075 | A | 1/1922 | Kolk |
| 1,925,155 | A | 9/1933 | Sanders |

(Continued)

FOREIGN PATENT DOCUMENTS

| | | | |
|---|---|---|---|
| JP | 10-63215 | A | 3/1989 |
| JP | 4-250489 | A | 9/1992 |

(Continued)

OTHER PUBLICATIONS

Communication dated Aug. 31, 2012 by the Japanese Patent Office in counterpart Japanese Application No. 2007-137457.

(Continued)

*Primary Examiner* — Patrick F Marinelli

(74) *Attorney, Agent, or Firm* — Sughrue Mion, PLLC

(57) ABSTRACT

A moving image display apparatus includes a display unit which sequentially displays an image pattern in the form of a moving image on a display screen, a storage unit which stores area sectional information and display format information, the area sectional information defines predetermined divided areas corresponding to the image pattern among a plurality of divided areas into which the display screen is divided, and the display format information defines display formats of the divided areas defined by the area sectional information in a time sequential manner, and a display control unit which controls to display the predetermined divided areas corresponding to the image pattern in accordance with the display formats defined by the display format information.

1 Claim, 9 Drawing Sheets

Related U.S. Application Data continuation of application No. 12/126,479, filed on May 23, 2008, now Pat. No. 8,847,856.

(52) U.S. Cl.
CPC . *G09G 2320/0261* (2013.01); *G09G 2350/00* (2013.01); *G09G 2360/02* (2013.01)

(58) Field of Classification Search
USPC ..... 345/55–59, 76–104, 204–215, 690–699; 315/169.1–169.4; 40/624, 421–425, 40/427–445, 541–583
See application file for complete search history.

(56) References Cited

U.S. PATENT DOCUMENTS

| | | | |
|---|---|---|---|
| 3,573,790 | A | 4/1971 | Schulenburg |
| 3,638,215 | A | 1/1972 | Payne |
| 4,024,531 | A | 5/1977 | Ashby |
| 4,079,367 | A | 3/1978 | Yonezawa |
| 4,142,182 | A | 2/1979 | Kmetz |
| 4,240,074 | A | 12/1980 | Gibson |
| 4,245,337 | A | 1/1981 | Daniels et al. |
| 4,333,715 | A | 6/1982 | Brooks |
| 4,682,162 | A | 7/1987 | Holloman |
| 4,716,405 | A | 12/1987 | Yamaguchi |
| 4,804,890 | A | 2/1989 | Havel |
| 5,062,057 | A | 10/1991 | Blacken |
| 5,138,783 | A | 8/1992 | Forsse |
| 5,198,803 | A | 3/1993 | Shie |
| 5,494,445 | A | 2/1996 | Sekiguchi |
| 5,695,346 | A | 12/1997 | Sekiguchi |
| 5,767,822 | A | 6/1998 | Hiroshi |
| 5,945,972 | A | 8/1999 | Okumura |
| 6,124,851 | A | 9/2000 | Jacobson |
| 6,583,577 | B1 | 6/2003 | Choi et al. |
| 6,651,365 | B1 | 11/2003 | Wainwright |
| 7,762,704 | B2 | 7/2010 | Brychell |
| 8,054,243 | B2 | 11/2011 | Sokolov |
| 8,217,922 | B2 | 7/2012 | Wainwright |
| 8,376,839 | B2 | 2/2013 | Lesley |
| 8,847,856 | B2 | 9/2014 | Nagahashi |
| 2002/0113796 | A1 | 8/2002 | Oshiyama et al. |
| 2003/0046838 | A1 | 3/2003 | O'Connell |
| 2003/0107535 | A1 | 6/2003 | Numao |
| 2003/0150146 | A1 | 8/2003 | Martin |
| 2003/0192213 | A1 | 10/2003 | O'Connell, Jr. |
| 2004/0226201 | A1 | 11/2004 | Lin |
| 2006/0207134 | A1 | 9/2006 | Harry |
| 2007/0018981 | A1 | 1/2007 | Zhang |
| 2007/0040770 | A1 | 2/2007 | Kim |
| 2007/0171158 | A1 | 7/2007 | Kumar |
| 2007/0222722 | A1 | 9/2007 | Sokolov |
| 2008/0231642 | A1 | 9/2008 | Okita |
| 2008/0291127 | A1 | 11/2008 | Nagahashi |
| 2009/0038189 | A1 | 2/2009 | Boks |

FOREIGN PATENT DOCUMENTS

| | | | |
|---|---|---|---|
| JP | 7-334132 | A | 12/1995 |
| JP | 10-240224 | A | 11/1998 |
| JP | 2001-42815 | A | 2/2001 |
| JP | 2003-58122 | A | 2/2003 |
| JP | 2006-84555 | A | 3/2006 |
| JP | 2006-150109 | A | 6/2006 |

OTHER PUBLICATIONS

Communication dated Sep. 4, 2012 by the Japanese Patent Office in counterpart Japanese Application No. 2007-137457.
Office Action dated Apr. 23, 2013, by the German Patent Office, in corresponding German Application No. 10 2008 025 177.1.

FIG. 7A

| NO. (D21) | COLOR (D22) | NO. (D21) | COLOR (D22) |
|---|---|---|---|
| 1 | WHITE | 5 | WHITE |
| 2 | WHITE | 6 | WHITE |
| 3 | BLACK | ⋮ | ⋮ |
| 4 | BLACK | | |

D2

FIG. 7B

| NO. (D21) | COLOR (D22) | NO. (D21) | COLOR (D22) |
|---|---|---|---|
| 1 | WHITE | 5 | BLACK |
| 2 | WHITE | 6 | WHITE |
| 3 | WHITE | ⋮ | ⋮ |
| 4 | WHITE | | |

D2

FIG. 7C

| NO. (D21) | COLOR (D22) | NO. (D21) | COLOR (D22) |
|---|---|---|---|
| 1 | WHITE | 5 | WHITE |
| 2 | WHITE | 6 | BLACK |
| 3 | WHITE | ⋮ | ⋮ |
| 4 | WHITE | | |

D2

FIG. 7D

| NO. (D21) | COLOR (D22) | NO. (D21) | COLOR (D22) |
|---|---|---|---|
| 1 | WHITE | 5 | WHITE |
| 2 | WHITE | 6 | BLACK |
| 3 | WHITE | ⋮ | ⋮ |
| 4 | BLACK | | |

D2

FIG. 7E

| NO. (D21) | COLOR (D22) | NO. (D21) | COLOR (D22) |
|---|---|---|---|
| 1 | WHITE | 5 | WHITE |
| 2 | BLACK | 6 | BLACK |
| 3 | WHITE | ⋮ | ⋮ |
| 4 | BLACK | | |

D2

MOVING IMAGE DISPLAY APPARATUS

CROSS-REFERENCE TO RELATED APPLICATIONS

This application is a continuation of U.S. Non-Provisional Application Ser. No. 14/445,336 filed Jul. 29, 2014, which is a continuation of U.S. Non-Provisional Application Ser. No. 12/126,479 filed on May 23, 2008, now U.S. Pat. No. 8,847,856, claiming the benefit of Japanese patent application No. 2007-137457 filed on May 24, 2007, the contents of which are incorporated by reference in its entirety.

BACKGROUND

The present invention relates to a moving image display apparatus. More particularly, the present invention relates to a moving image display apparatus for displaying a desirable image pattern on a display screen on a display unit in the form of a moving image.

Conventionally, when drive conditions (for example, drive speeds) of vehicles are displayed in the form of digital numeral values, there are such display apparatuses that while dot matrix type display devices are employed, numerals are displayed by turning ON or OFF dots (refer to, for example, patent publication 1). For example, in a matrix type display device constituted by 5 rows×5 columns, turn-ON/turn-OFF operations of the respective dots are controlled in correspondence with numerals which are wanted to be displayed. As an example, when numeral "1" is displayed, dots positioned in a first row and third and fourth columns, a dot positioned in a second row and a fourth column, a dot positioned in a third row and a fourth column, a dot positioned in a fourth row and a fourth column, and also, a dot positioned in a fifth row and a fourth column are turned ON, whereas the remaining dots are turned OFF. Also, when numeral "2" is displayed, dots positioned in the first row and all columns, a dot positioned in the second row and the fifth column, dots positioned in the third row and all columns, a dot positioned in the fourth row and the first column, and further, dots positioned in the fifth row and all columns are turned ON, whereas the remaining dots are turned OFF. Also, when numeral "3" is displayed, dots positioned in the first row and all columns, a dot positioned in the second row and the fifth column, dots positioned in the third row and second, third, fourth and fifth columns, a dot positioned in the fourth row and the fifth column, and further, dots positioned in the fifth row and all columns are turned ON, whereas the remaining dots are turned OFF. Also, when numeral "4" is displayed, dots positioned in the first row and third and fourth columns, dots positioned in the second row and second and fourth columns, dots positioned in the third row and first and fourth columns, dots positioned in the fourth row and all columns, and further, a dot positioned in the fifth row and the fourth column are turned ON, whereas the remaining dots are turned OFF.

[Patent Publication 1] JP-A-10-63215

However, in such a case that a moving image is displayed in the conventional display apparatus, since a plurality of display screens are previously prepared, these plural display screens are displayed one by one so as to be represented as the moving image. As a result, amounts of data are increased, depending upon sizes of the displays screens, total numbers of display colors, and reproducing times, so that there are limitations in data capacities, data transfer times, and drawing times. For instance, an amount of image data which are required for reproducing 5 frames of moving images on such a screen of WVGA (namely, screen resolution (256 colors) of screen size 800×480 constitutes 800×480×5=1,875 (KB)). If the reproducing time is prolonged, or the reproducing speed is increased, then there is such a problem that resulting data amounts may become larger.

SUMMARY

As a consequence, the present invention has been made to solve the above-described problems, and therefore, has an object to provide a moving image display apparatus capable of displaying a desirable image pattern in the form of a moving image by employing a small amount of data.

In order to achieve the above object, according to the present invention, there is provided a moving image display apparatus, comprising:

a display unit which sequentially displays an image pattern in the form of a moving image on a display screen;

a storage unit which stores area sectional information and display format information, wherein the area sectional information defines predetermined divided areas corresponding to the image pattern among a plurality of divided areas into which the display screen is divided, and the display format information defines display formats of the divided areas defined by the area sectional information in a time sequential manner; and a display control unit which controls to display the predetermined divided areas corresponding to the image pattern in accordance with the display formats defined by the display format information.

In accordance with the above configuration, the display control unit displays the display screen on the display unit such a manner that the divided areas corresponding to the image pattern defined by the area sectional information. As a result, the information used to display the moving image on the display screen can be reduced only to the area sectional information and the display format information for one display screen.

Preferably, the display format information includes area identification data and display color identification data, wherein the area identification data identifies the divided areas to be set with the display formats, and the display color identification data changes a display color of the divided areas identified by the area identification data. The display control unit controls to display the predetermined divided areas corresponding to the image pattern while changing the display color of the divided areas in accordance with the area identification data and the display color identification data.

By the above configuration, the display control unit displays the display screen on the display unit by changing the display color of the divided areas corresponding to the image pattern based upon both the area identification data and the display color identification data. As a result, the display color can be changed every divided areas.

Preferably, the area sectional information includes area sectional data which defines divided areas corresponding to a plurality of the image pattern for displaying the image pattern moves to a different position on the image screen as the moving image. The display control unit controls to display the divided areas corresponding to the image patterns so that the image pattern moves to the different position on the image screen in accordance with the area sectional data and the display formats defined by the display format information.

By the above configuration, the display control unit displays the display screen in such a manner that the image pattern is moved based upon the area sectional data and the display format indicated by the display format information. As a result, an amount of the image data required to be displayed as the moving image can be furthermore decreased.

As previously described, in accordance with the moving image display apparatus of the present invention, the information used to display the moving image on the display screen can be reduced only to the area sectional information and the display format information for one display screen. As a result, the data capacity can be reduced, and also, the workload of the process operations when the data is processed can be reduced. As a consequence, it is possible to provide the moving image display apparatus capable of displaying the moving image by employing the small data amount.

Also, since the display color can be changed with respect to each of the divided areas, a desirable mark and the like can be flickered, and furthermore, gradation changes can be represented in a stepwise manner by merely employing the area identification data and the display color identification data. As a result, display effects such as a flickering effect and a fade-in and fade-out effect can be realized by employing the smaller data amount.

Also, the moving image can be displayed by merely changing the display format indicated by the display format information in the time sequential manner. As a result, an amount of image data required for displaying the image data as the moving image can be furthermore reduced.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 7A to 7E are explanatory diagrams for explaining a plurality of display format information corresponding to the divided areas shown in FIG. 6;

DETAILED DESCRIPTION OF EXEMPLARY EMBODIMENTS

Referring now to FIG. 1 to FIG. 10, a description is made of one embodiment of a moving image display apparatus according to the present invention. It should be understood that in the present invention, a display of a moving image implies a change in display colors and movement with respect to a predetermined image pattern.

Figure 1:
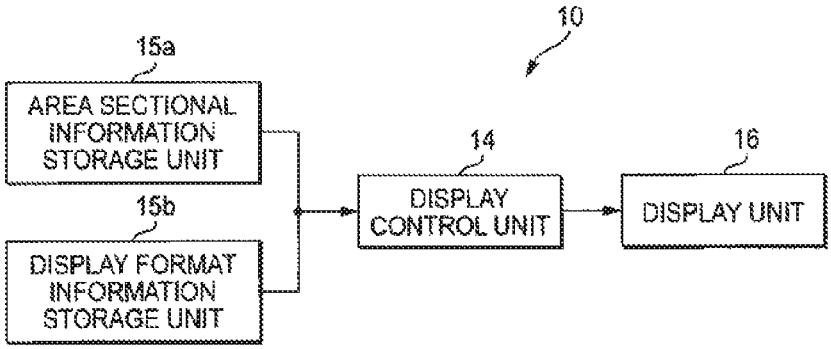
FIG. 1 is a structural diagram for showing a basic structure of a moving image display apparatus according to the present invention.

FIG. 1 is a structural diagram for showing a basic structure of a moving image display apparatus. A moving image display apparatus 10 includes an area sectional information storage unit 15*a* for storing thereinto area sectional information, a display format information storage unit for storing thereinto display format information which defines display formats of the divided areas indicated by the area sectional information in a time sequential manner, and a display control unit 14 for displaying the display screen on the display unit 16 in such a manner that a divided area corresponding to each of sections indicated by the area sectional information are displayed in accordance with a display format indicated by the display format information.

Figure 2:
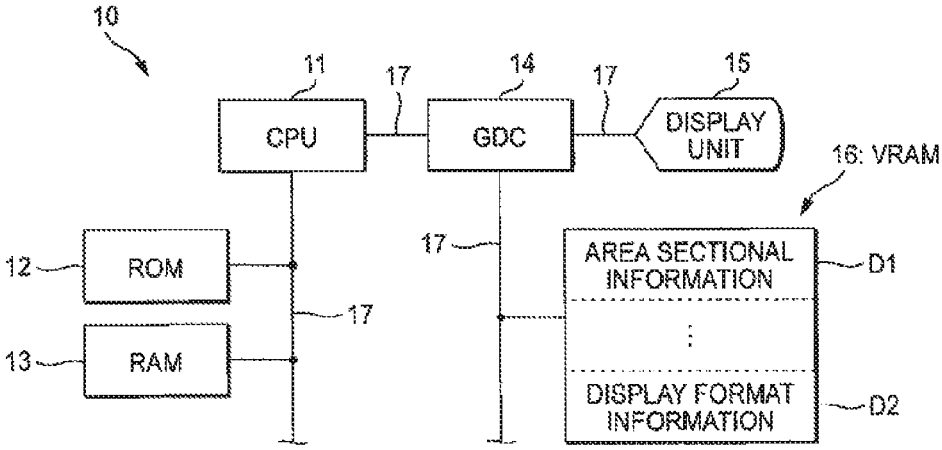
FIG. 2 is a diagram for representing a schematic system arrangement of the moving image display apparatus according to the present invention.

In FIG. 2, a moving image display apparatus 10 includes a central processing unit (CPU) 11, a ROM 12, a RAM 13, a GDC (Graphics Display Controller) 14, a display unit 15, and a VRAM (Video Random Access Memory) 16. The central processing unit 11 executes various sorts of process operations and various sorts of control operations in accordance with a predetermined program. The ROM 12 corresponds to a read-only memory which previously stores thereinto the program for the CPU 11, and the like. The RAM 13 corresponds to such a readable and writable memory having areas which are required to store thereinto various sorts of data, and required to execute process operations of the CPU 11.

The ROM 12, the RAM 13, and the GDC 14 are connected to the CPU 11 via a bus 17 in order that various sorts of data can be inputted and/or outputted. Also, both the display unit 15 and the VRAM 16 are connected via the bus 17 to the GDC 14 in order that various sorts of data can be inputted and/or outputted.

The ROM 12 stores thereinto, for instance, a program and the like, which control entire process operations executed in the moving image display apparatus 10. The moving image display apparatus 10 is assembled in, for instance, a graphic data, or the like. Since the CPU 11 executes the above-described program, the CPU 11 outputs a display request of a desirable display screen to the GDC 14.

When the GDC 14 receives the display request from the CPU 11, the GDC 14 draws a display screen on the display unit 15 based upon data of the VRAM 16 so as to display the desirable display screen on the display unit 15. In other words, the GDC 14 corresponds to a display control unit. It should also be understood that in the present embodiment, although the following case will be described, the present invention is not limited only to this case, but may be alternatively embodied in another embodiment in which the CPU 11 may directly perform the drawing control operation. In the first-mentioned embodiment case, since the GDC 14 executes the drawing operation, the work load which should be originally carried out by the CPU 11 may be reduced.

In the display unit 15, a dot matrix type liquid crystal display apparatus, or the like is employed, while the dot matrix type liquid crystal display apparatus is capable of drawing characters, figures, and the like on the display screen by turning ON/OFF display units (pixels) which are arrayed in rows and columns along a lateral direction and a longitudinal direction of the display unit 15. Then, the display unit 15 displays the pixels which are turned ON/OFF under control of the GDC 14 so as to display a desirable display screen.

The VRAM 16 is a memory which saves and stores a content displayed on the display unit 15. The VRAM 15 stores both area sectional information "D1", and one piece, or plural pieces of display format information "D2" which correspond to the area sectional information "D1." As previously described, the VRAM 16 functions as an area sectional information storage unit and a display format information storage unit. It should also be understood that a single pixel or a collected body made of a plurality of pixels of the display unit 15, or the like may be arbitrarily defined as the area sectional information "D1".

The area sectional information "D1" corresponds to information which is employed so as to section a plurality of divided areas in such a manner that a desirable image pattern is displayed in the form of a moving image with respect to the plurality of divided areas produced by previously dividing the display screen. The area sectional information "D1" has area sectional data "D11" which is employed so as to section such divided areas which change an image pattern as the moving image.

The display format information "D2" corresponds to information which is employed so as to define display formats of the divided areas in a time sequential manner, while the area sectional information "D1" indicates the divided areas. The display format information has area identification data "D21", and display color identification data "D22." The area identification data "D21" is employed so as to identify a section of the divided areas. The display color identification data "D22" is employed so as to change a display color of the divided areas corresponding to the area identification data D21. In other words, both the area sectional information "D1" and the display format information "D2" are related to each other based upon the area sectional data D11 and the area identification data D21.

Figure 3A:
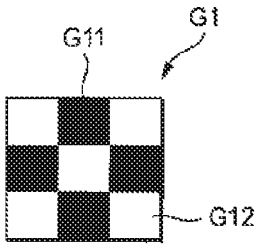
FIGS. 3A and 3B are diagrams for explaining relationship between display screens and divided areas.
Figure 3B:
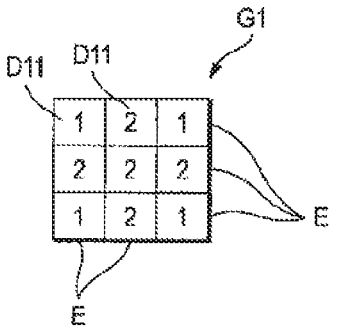
Figure 4A:
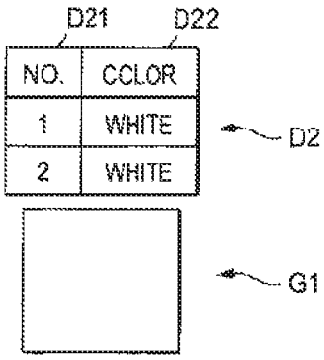
FIGS. 4A to 4E are explanatory diagrams for explaining an exemplification as to a plurality of display format information corresponding to the divided areas of FIG. 3B, and display examples thereof.
Figure 4B:
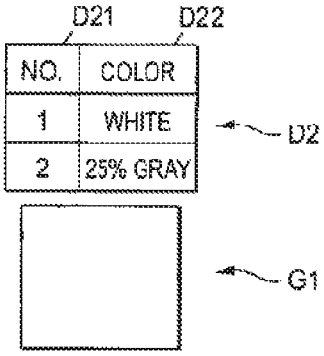
Figure 4C:
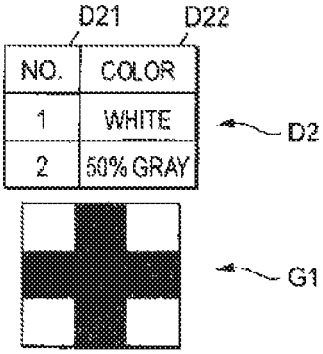
Figure 4D:
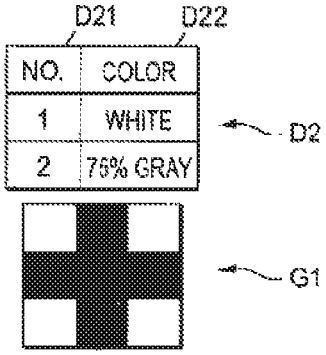
Figure 4E:
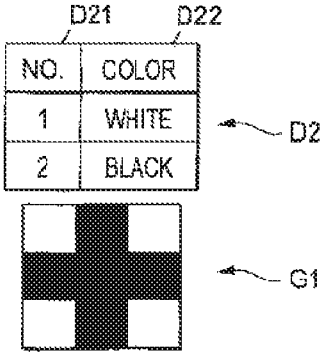
Figure 5A:
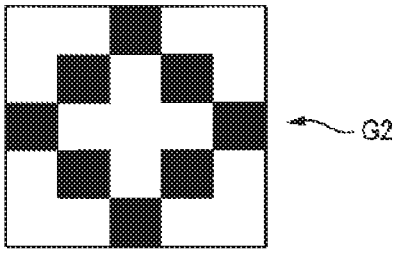
FIGS. 5A to 5E are explanatory diagrams for explaining a plurality of image patterns which are displayed on the display screens.
Figure 5B:
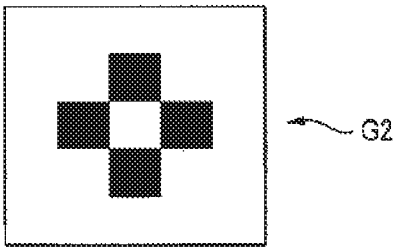
Figure 5C:
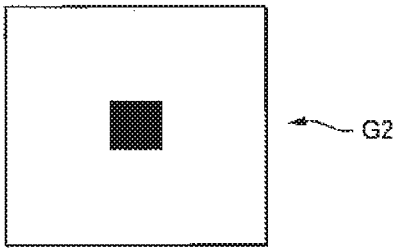
Figure 5D:
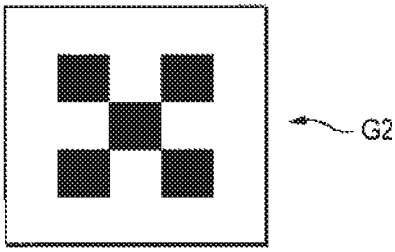
Figure 5E:
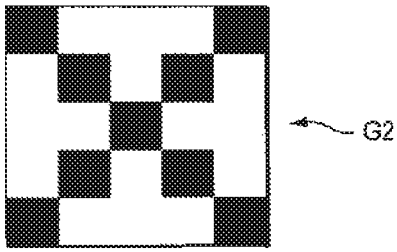

For instance, in such a case that a display screen "G1" indicated in FIG. 3A is displayed on the display unit 15 in the form of a moving image which flickers (namely, fades in and fades out), the display image "G1" can be discriminated as an image "G11" which is intended for the moving image, and another image "G12" which is not intended for the moving image, namely, a background etc. Then, as represented in FIG. 3B, the display screen "G1" is sectioned into a plurality of divided areas "E" constructed of 3 rows and 3 columns in correspondence with the image "G11." Among the plurality of divided areas "E", numeral "2" is set to such divided areas "E" corresponding to the image "G11" as the area sectional data "D11", whereas numeral "1" is set to such divided areas "E" corresponding to the image "G12", so that the area sectional information "D1" is formed.

Five pieces of display format information "D2" shown in FIG. 4A to FIG. 4E are stored in the VRAM 16 in relation to the area sectional information "D1" in the time sequential manner. As represented in FIG. 4A to FIG. 4E, numerals "1" and "2" are set to the area identification data "D21" of the display format information "D2", whereas the below-mentioned data are set to the display color identification data "D22", while these data indicate "white" and "white"; "white" and "25% gray"; "white" and "50% gray"; "white" and "75% gray"; and "white" and "black" colors, respectively.

When the GDC 14 receives a display request from the CPU 11, the GDC 14 extracts both area section information "D1" corresponding to the received display request, and also, display format information "D2" related to the above-described area section information "D1" from the VRAM 16. Then, the GDC 14 switches the divided areas "E" corresponding to every section indicated by the area sectional information "D1", and the GDC 14 switches the display format information "D2" corresponding to the area sectional information "D1" every predetermined time so as to be observed, and the GDC 14 draws the display screen "G" on the display unit 15 in order that the divided area "E" indicated by the area identification data "D21" becomes such a display color indicated by the display color identification data "D22." As a result, as represented in FIG. 4A to FIG. 4E, such display screens "G1" are displayed on the display unit 15 as follows: That is, the images "G11" which is intended for the moving image are changed in such a manner that density from a white color to a gray color is gradually increased, and finally, the display color becomes a black color.

Figure 6:
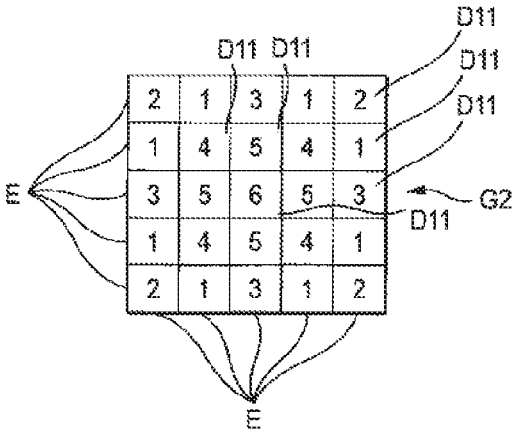
FIG. 6 is an explanatory diagram for explaining divided areas corresponding to the image patterns of FIGS. 5A to 5E.

Also, in such a case that image patterns shown in FIG. 5A to FIG. 5E are displayed as an animation (moving image) on the display screens "G2", both the area sectional information "D1" and the display format information "D2" may be constructed as follows:

That is, as indicated in FIG. 6, the area sectional information "D1" is sectioned into such divided areas "E" constructed of 5 rows and 5 columns in correspondence with the image patterns shown in FIG. 5A to FIG. 5E, and the area sectional data "D11" of "1" to "6" is allocated to these plural divided areas "E" in order to become the image patterns. For example, the area sectional data "D11" is set so as to form the area sectional information "D1" in such a manner that the image pattern corresponding to FIG. 5A becomes either "3" or "4"; the image pattern corresponding to FIG. 5B becomes "5"; the image pattern corresponding to FIG. 5C becomes "6"; the image pattern corresponding to FIG. 5D becomes either "4" or "6"; and the image pattern corresponding to FIG. 5E becomes "2", "4", and "6"; and further, the divided area "E" whose display color is not changed becomes "1."

Five pieces of display format information "D2" represented in FIG. 7A to FIG. 7E are stored in the VRAM 16 in a time sequential manner in relation to the above-described area sectional information "D1." As shown in FIG. 7A to FIG. 7E, numerals "1" to "6" corresponding to the above-described area sectional data "D11" are set to the area identical data "D21" of the display format information "D2"; and such a data that the display color of the divided area "E" indicates either the "white" or "black" color is set to each of the display color identification data "D22" in order to become the image patterns shown in FIG. 5A to FIG. 5E.

When the GDC 14 receives a display request from the CPU 11, the GDC 14 extracts both area section information "D1" corresponding to the received display request, and also, display format information "D2" related to the above-described area section information "D1" from the VRAM 16. Then, the GDC 14 switches the divided areas "E" corresponding to every section indicated by the area sectional information "D1", and the GDC 14 switches the display format information "D2" corresponding to the area sectional information "D1" every predetermined time so as to be observed, and the GDC 14 draws the display screen "G" on the display unit 15 in order that the divided area "E" indicated by the area identification data D21 becomes such a display color indicated by the display color identification data "D22." As a result, such display screens "G2" that the moving image patterns shown in FIG. 7A to FIG. 7E are gradually changed every predetermined time are displayed on the display unit 15.

In accordance with the above-described moving image display apparatus 10 of the present invention, the information used to display the moving image on the display screen can be reduced only to the area sectional information "D1" and the display format information "D2" for one screen as to each of the display screens "G1" and "G2." As a result, the data capacity can be reduced, and also, the workload of the process operations when the data is processed can be reduced. As a consequence, it is possible to provide the moving image display apparatus 10 capable of displaying the moving image by employing the small data amount.

Also, since the display color can be changed with respect to each of the divided areas "E", the desirable mark and the like can be flickered, and furthermore, the gradation changes can be represented in the stepwise manner by merely employing the area identification data "D21" and the display color identification data "D22." As a result, the display effects such as the flickering effect and the fade-in and fade-out effect can be realized by employing the smaller data amount.

In the above embodiment, the display format information "D2" is made of palette tables as shown in FIG. 4 and FIG. 7. However, the present invention is not limited to the palette tables. The display format information "D2" may be alternatively made of program, for example, while palette numbers are set as the display color identification data "D22" of the display format information "D2", the GDC 14 may gradually change the palette numbers in accordance with a predetermined program to change the display format.

Figure 8:
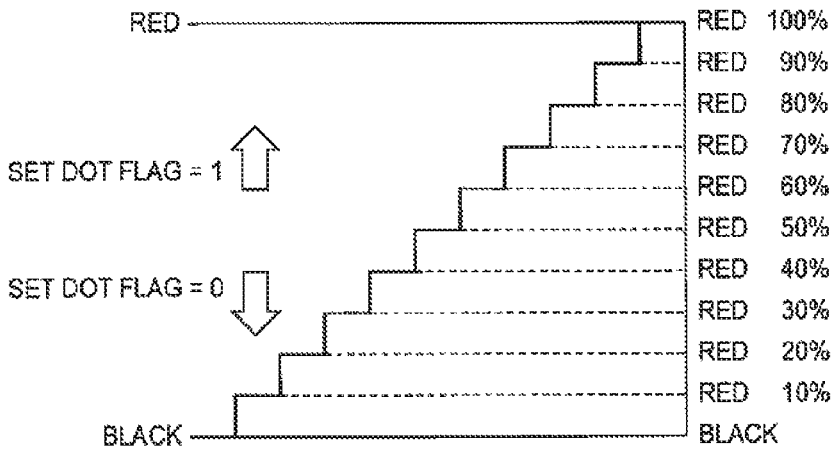
FIG. 8 is an explanatory diagram for explaining a display exemplification in which the image patterns of the display screens are changed from a black color to a red color in a stepwise manner.

For instance, while a display color control program is previously stored in a memory built in the GDC 14, or the like, palette numbers (display colors) are previously stored in the display color identification data "D22" of the display format information "D2." The display color control program changes the display color of the image "G11" which is intended for the moving image of the display screen "G1" shown in FIG. 3A in eleven stages defined from a red color to a black color as represented in FIG. 8, and flickers the changed display color. Then, the GDC 14 refers to both the area sectional information "D1" and the display format information "D2" related to this area sectional information "D1", and sets the palette number of the display color identification data "D22" as an initial value so as to execute the above-described display color control program. In this example, a description is made of the process operation as to such a case that the palette number indicative of "black" is stored as the initial value.

Figure 9:
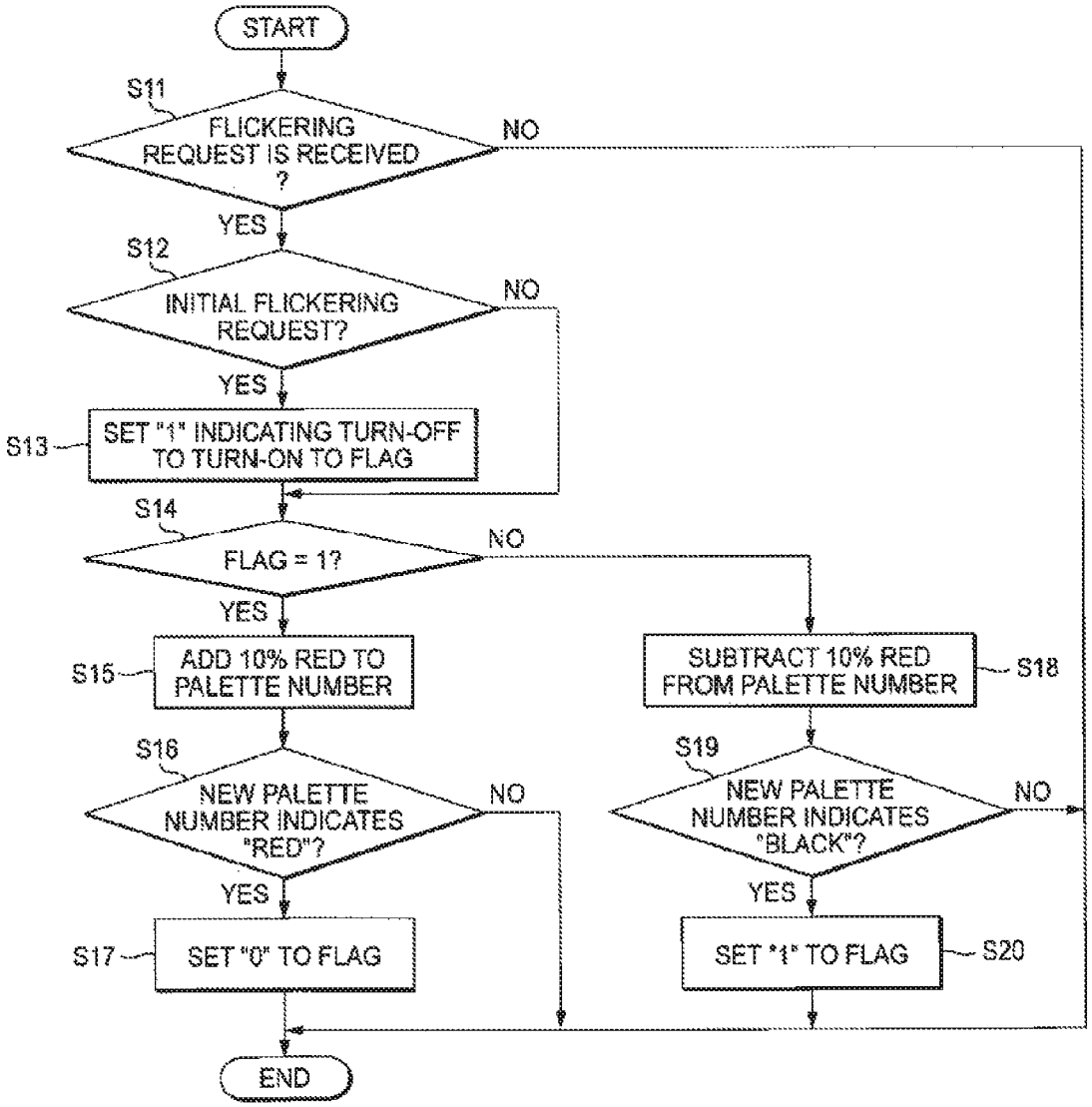
FIG. 9 is a flow chart for describing one example as to a summarized process operation executed by a GDC in order to realize the display example shown in FIG. 8.

As one example of the above-described display color control program, a flow chart represented in FIG. 9 may be conceived. Then, in a step S11 of the flow chart, the GDC 14 judges whether or not a flickering request is received from the CPU 11. When the GDC 14 judges that the flickering request is not received ("NO" in step S11), the process operation of the display color control program is accomplished. On the other hand, when the DGC 14 judges that the flickering request is received ("YES" in step S11), in a step S12, the GDC 14 refers to a flag of the built-in memory so as to judge whether or not an initial turn-ON operation is performed. When the GDC 14 judges that the initial turn-ON operation is not performed ("NO" in step S12), the process operation is advanced to a step S14. On the other hand, in such a case that the GDC 14 judges that the initial turn-ON operation is performed ("YES" in FIG. 12), the GDC 14 sets "1" indicative of "turn-OFF→turn-ON" to the flag in a step S13.

In a step S14, the GDC 14 judges whether or not the above-described flag is equal to "1." When the GDC 14 judges that the flag is equal to "1" ("YES" in step S14), the GDC 14 adds 10% of the red color to the present palette number so as to set a new palette number in a step S15. Then, in a step S16, the GDC 14 judges whether or not the palette number indicates "red." When the GDC 14 judges that the palette number does not indicate "red" ("NO" in step S16), the GDC 14 accomplishes the process operation. On the other hand, when the GDC 14 judges that the palette number indicates "red" ("YES" in step S16), the GDC 14 sets "0" to the above-described flag in a step S17, and then, accomplishes the process operation.

Also, in the case that the GDC 14 judges that the above-described flag is not equal to "1" in the step S14 ("NO" in step S14), the GDC 14 subtracts 10% of the red color from the present palette number so as to set a new palette number in a step S18. Then, in a step S19, the GDC 14 judges whether or not the palette number indicates "black." When the GDC 14 judges that the palette number does not indicate "black" ("NO" in step S19), the GDC 14 accomplishes the process operation. On the other hand, when the GDC 14 judges that the palette number indicates "black" ("YES" in step S19), the GDC 14 sets "1" to the above-described flag in a step S20, and then, accomplishes the process operation.

When a series of the process operations indicated in FIG. 9 are accomplished, the GDC 14 draws the display screen "G" on the display unit 15 in order that the display color as to the divided areas "E" indicated by the area identification data "D21" may become such a display color which is indicated by the palette number set to the display color identification data D22, so that the display screen "G2" is displayed on the display unit 15 in which the moving image pattern represented in FIG. 3A has been gradually changed from the black color to the red color.

Even when the moving image display apparatus 10 of the present invention is constructed in the above-described manner, the information used to display the moving image on the display screen "G1" can be reduced only to the area sectional information "D1" and the display format information "D2" for one screen of the display screen "G1." As a result, the data capacity can be reduced, and also, the workload of the process operations when the data is processed can be reduced. As a consequence, it is possible to provide the moving image display apparatus 10 capable of displaying the moving image by employing the small data amount. In addition, even when the sort of the display color identification data "D22" is not increased, the display color can be changed in the stepwise manner. As a result, it is possible to avoid that the data amount is increased due to the increase in the moving image patterns.

Figure 10:
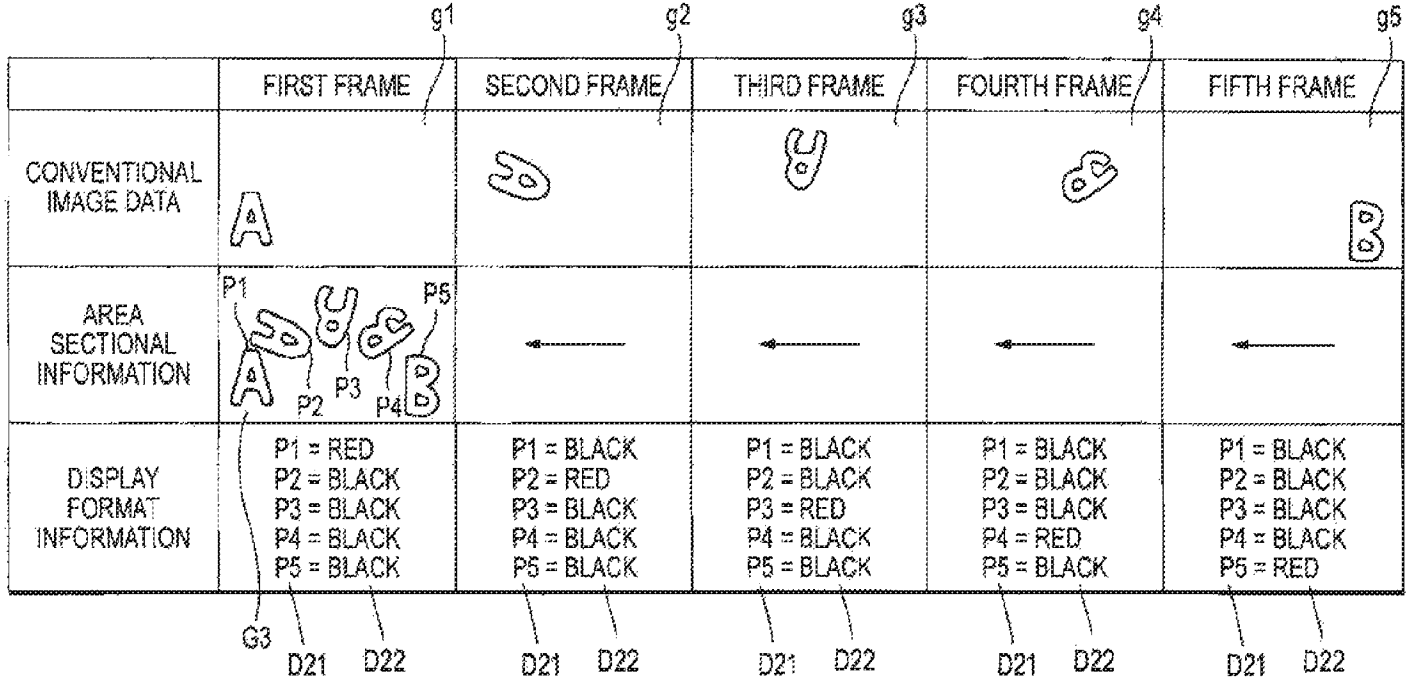
FIG. 10 is an explanatory diagram for explaining an embodiment mode in which image patterns of display screens are moved to be displayed.

Also, as shown in FIG. 10, in the conventional technique, while five frames of display screens "g1" to "g5" must be previously prepared, these display screens "g1" to "g5" must be switched in the time sequential manner and the switched display screens must be displayed on the display unit 15. To the contrary, in the moving image display apparatus 10 of the present invention, all of moving image patterns "P1" to "P5" of the display screens "g1" to "g5" are sectioned on the display screen "G3"; this area is divided into such divided areas "E" which correspond to the respective moving image patterns "P1" to "P5"; and then, area sectional information "D1" is formed. Then, 5 pieces of display format information "D2" which correspond to the area sectional information "D1" are formed; the moving image patterns "P1" to "P5" are set with respect to the respective area identification data "D21"; and furthermore, the palette number corresponding to either "black" or "red" color is set to the respective display color identification data "D22." It is so assumed that an area of the display screen "G3" except for the moving image patterns "P1" to "P5" is fixed as a background, and is continuously displayed in a black color.

Then, in the display format information "D2", the palette number of "red" color is set only to the display color identification data "D2" where the area identification data D21 corresponds to "P1" with respect to the first frame, and the palette number of "black" color is set to other display color identification data "D2." As explained above, the display color identification data "D22" to which the palette number of "red" color is set in correspondence with each of the first frame to the fifth frame is changed in order to form the display format information "D2."

As a result, the GDC 14 switches the display format information "D2" represented in FIG. 10 every time a predetermined time has elapsed and refers to the switched display format information "D2", and then, draws a display screen "G" on the display unit 15 in such a manner that the display color of the divided area "E" indicated by the area identification data "D21" becomes such a display color indicated by the display color identification data "D22." As a result, such a display screen "G3" that the first frame to the fifth frame of the moving image patterns "P1" to "P5" shown in FIG. 10 is displayed on the display unit 15. In other words, such a display operation that while symbol "A" is deformed along a left direction as viewed in the screen, this symbol "A" is moved to be changed into another symbol "B" can be carried out without employing the 5 frames of image data, although the 5 frames of image data were employed in the conventional technique.

As a consequence, even when the moving image display apparatus 10 of the present invention is constructed in the above-described manner, the information used to display the moving image on the display screen "G3" can be reduced only to the area sectional information "D1" and the display format information "D2" for one screen of the display screen "G3." As a result, the data capacity can be reduced, and also, the workload of the process operations when the data is processed can be reduced. Accordingly, it is possible to provide the moving image display apparatus 10 capable of displaying the moving image by employing the small data amount. In addition, the moving image can be displayed by merely changing the display format indicated by the display format information "D2" in the time sequential manner. As a result, the amount of the image data required to display the above-described information in the form of the moving image can be furthermore reduced.

It should also be noted that although the above embodiment is explained such a case that one area sectional information "D1" and the plurality of display format information "D2" related to this area sectional information "D1" are stored in the VRAM 16, the present invention is not limited thereto. Alternatively, while plural pieces of area sectional information "D1" are switched, a display control operation may be carried out, so that more complex image patterns may be displayed in the form of moving images.

As previously described, since the above-described embodiment merely indicates the typical embodiment of the present invention, the present invention is not limited only to the above-described embodiment. In other words, the present embodiment may be alternatively modified without departing from the technical sprit and scope of the present invention.

What is claimed is:

1. A moving image display apparatus, comprising:

a display configured to display image patterns on a dot-matrix type display screen;

a storage configured to store area sectional information and display format information, the area sectional information defining divided areas corresponding to the image patterns from a plurality of divided areas into which the dot-matrix type display screen is divided in a matrix, and the display format information defining display formats of the divided areas defined by the area sectional information in a time sequential manner; and a display controller configured to control the display to display the corresponding divided areas defined by the area sectional information in accordance with the display formats defined by the display format information to display the image patterns in the form of a moving image in the time sequential manner, wherein one area identification data among a plurality of area identification data commonly identifies two or more divided areas among the divided areas to be set with a common display format, and wherein a display effect of the two or more divided areas commonly identified by the one area identification data is changed in the time sequentially manner with the common display format.

* * * * *